US011112072B2

(12) United States Patent
Xue et al.

(10) Patent No.: US 11,112,072 B2
(45) Date of Patent: Sep. 7, 2021

(54) STRIP LAMP

(71) Applicants: Self Electronics Co., Ltd., Zhejiang (CN); Wanjiong Lin, Zhejiang (CN); Self Electronics USA Corporation, Norcross, GA (US)

(72) Inventors: Yuanfang Xue, Zhejiang (CN); Huangfeng Pan, Zhejiang (CN); Quan Zhu, Zhejiang (CN); Zhaoyong Zheng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/949,680

(22) Filed: Nov. 10, 2020

(65) Prior Publication Data

US 2021/0190276 A1 Jun. 24, 2021

(30) Foreign Application Priority Data

Dec. 24, 2019 (CN) ..... 201911349454.9

(51) Int. Cl.

| | |
|---|---|
| ***F21S 4/28*** | (2016.01) |
| ***F21V 1/14*** | (2006.01) |
| ***F21V 5/00*** | (2018.01) |
| ***F21V 5/04*** | (2006.01) |
| ***F21V 13/02*** | (2006.01) |
| ***F21Y 105/16*** | (2016.01) |
| ***F21Y 103/10*** | (2016.01) |
| ***F21Y 115/10*** | (2016.01) |

(52) U.S. Cl.

CPC ..... *F21S 4/28* (2016.01); *F21V 1/143* (2013.01); *F21V 5/007* (2013.01); *F21V 5/04* (2013.01); *F21V 13/02* (2013.01); *F21Y 2103/10* (2016.08); *F21Y 2105/16* (2016.08); *F21Y 2115/10* (2016.08)

(58) Field of Classification Search

CPC .... F21S 4/28; F21S 4/20; F21V 5/007; F21V 5/04; F21K 9/275; F21K 9/278

See application file for complete search history.

(56) References Cited

U.S. PATENT DOCUMENTS 8,167,466 B2 * 5/2012 Liu ..... F21V 29/507 362/373

2010/0254138 A1 * 10/2010 Chen ..... F21V 5/007 362/236

(Continued)

*Primary Examiner* — William N Harris

(74) *Attorney, Agent, or Firm* — Wang Law Firm, Inc.

(57) ABSTRACT

A strip lamp includes a strip lamp holder, provided with two light source mounting seat oppositely arranged and located on both sides of the center line; two rows of light sources, respectively arranged on the two light source mounting seats, and the light emission directions are all toward the illuminated surface and the two optical axes intersect at or near the center line; two lenses, respectively arranged on a light source mounting seat and located in the light emission direction of the corresponding light source, and both include a light entrance surface and a light emission surface. The shielding of the light source mounting seats on the opposite side of the light source reduces glare, on the one hand, the setting of the light shield is reduced and the light output efficiency is improved. On the other hand, the strip lamp also has a better anti-glare effect.

14 Claims, 5 Drawing Sheets

(56) References Cited

U.S. PATENT DOCUMENTS

| | | | | |
|---|---|---|---|---|
| 2012/0043884 | A1* | 2/2012 | Lee | F21V 29/89 315/32 |
| 2012/0218757 | A1* | 8/2012 | Gill | F21V 29/74 362/235 |
| 2020/0355345 | A1* | 11/2020 | Yeo | F21V 7/005 |

* cited by examiner

STRIP LAMP

RELATED APPLICATION

This application claims priority to a Chinese Patent Application No. CN 201911349454.9, filed on Dec. 24, 2019, the whole content of which is hereby incorporated by reference.

FIELD OF THE TECHNOLOGY

The present invention relates to the field of lighting fixtures, with particular emphasis on a strip lamp.

BACKGROUND OF THE INVENTION

Compared with traditional lighting lamps, LED lamps have the advantages of small size, low energy consumption and high light efficiency. Thus, LED lamps can be quickly promoted and applied. At the same time, people are constantly pursuing better lighting effects, so they also hope that LED lamps can meet various lighting needs. Especially when a large area is required to be illuminated, it is desirable to make the illumination of the illuminated area as uniform as possible. Since the light-emitting effect of the LED chip cannot meet the lighting requirements, it is necessary to perform secondary optical design through lens coordination to meet specific light distribution requirements. According to the principles of light irradiation, compared to the illuminated area where the light illumination distance is short, the farther the light is emitted and imaged, the stronger the scattering and the larger the illumination range. Therefore, the illumination is the smaller in the illumination area where the illumination distance is farther, resulting in an uneven illumination.

For this reason, some researchers have proposed a light source that is arranged obliquely to the optical axis of the surface to be illuminated, combined with the light distribution of optical elements to achieve uniform and large-area light output. At this time, glare problems will occur. It is necessary to install an anti-glare cover in the light output direction. Due to size issues, the anti-glare cover is generally set close, and the light output efficiency will decrease at this time.

BRIEF SUMMARY OF THE INVENTION

In view of this, the present invention provides a strip lamp to solve the above technical problems. In particular it is an object of the present invention to provide a strip lamp of simple and cost-effective configuration enabling a uniform illumination.

This problem is solved by a strip lamp as claimed by claim 1. Further advantageous embodiments are the subject-matter of the dependent claims.

According to the present invention there is provided a strip lamp comprising a strip lamp holder, two rows of light sources and two lenses, wherein: the strip lamp holder has a center line perpendicular to the surface to be illuminated in a plane perpendicular to its length direction, and the strip lamp holder is provided with two light source mounting seat oppositely arranged and located on opposite sides of the center line; each of the two rows of light sources is respectively arranged on a light source mounting seat so that the light emission directions of the two rows of light sources are all toward the surface to be illuminated and so that the two optical axes intersect at or near the center line; each of the two lenses is respectively arranged on a light source mounting seat and located in the light emission direction of the corresponding light source, and each of the two lenses includes a light entrance surface and a light emission surface.

The light from the light source comprises a blocked light extending to below the top edge of the light source mounting seat on the opposite side of the light source mounting seat, and a part of the light emission surface far away from the illuminated surface causes the blocked light of the light source to be refracted and then to cross the top edge of the light source mounting seat on the opposite side of the light source mounting seat.

According to a further embodiment, the included angle between the optical axis and the center line is in the range between 50° and 80°.

According to a further embodiment, the light emission direction of maximum intensity of the light from the light source after passing through the corresponding lens is defined as a light distribution optical axis, and the included angle between the light distribution optical axis and the center line is in the range between 60° and 85°.

According to a further embodiment, the extension line of the light distribution optical axis is located above the top edge of the light source mounting seat on the opposite side thereof.

According to a further embodiment, the included angle between the light distribution optical axis and the center line is in the range between 70° and 85°.

According to a further embodiment, the light from the light source is refracted and distributed on the light entrance surface and the light emission surface.

According to a further embodiment, the light emission surface comprises a first light focusing part and a second light focusing part, According to a further embodiment, the first light focusing part causes the blocked light of the light source to be refracted and to cross the top edge of the light source mounting seat on the opposite side thereof, and is located on the side of the light distribution optical axis away from the surface to be illuminated; and focuses the light corresponding to the light source to the light distribution optical axis.

According to a further embodiment, the second light focusing part is located on the side of the light distribution optical axis close to the surface to be illuminated, and focuses the light corresponding to the light source to the light distribution optical axis.

According to a further embodiment, the light emission surface further comprises a diffusion part connected to one end of the second light focusing part away from the light distribution optical axis.

According to a further embodiment, the light entrance surface is recessed toward the light emission surface.

According to a further embodiment, the lens is a strip lens extending along the length direction of the strip light holder.

According to a further embodiment, the light source comprises a plurality of point light sources arranged at intervals along the length direction, and the lens is a single lens provided corresponding to each point light source.

According to a further embodiment, the light source comprises a plurality of point light sources arranged at intervals along the length direction the, and the lenses each comprise a mounting board extending along the length direction of the strip light holder into which multiple single lenses are integrated, each of the single lenses being associated with a corresponding light source of the associated row of light sources and each of the single lenses comprising a light entrance surface and a light emission surface.

According to a further embodiment, the strip lamp further comprises a lampshade arranged on the strip lamp holder and located outside the lens.

According to a further embodiment, the lampshade is an arc-shaped curved surface convex along the light emission direction.

In the strip lamp of the present invention, by arranging two opposing light source mounting seats in the strip light frame, the shielding of the light source mounting seats on the opposite side of the light source reduces glare, on the one hand, the setting of the light shield is reduced and the light output efficiency is improved. On the other hand, it also has a better anti-glare effect.

BRIEF DESCRIPTION OF THE DRAWINGS

The following describes embodiments of the present invention with reference to the accompanying drawings, in which.

DETAILED DESCRIPTION OF THE INVENTION

Figure 1:
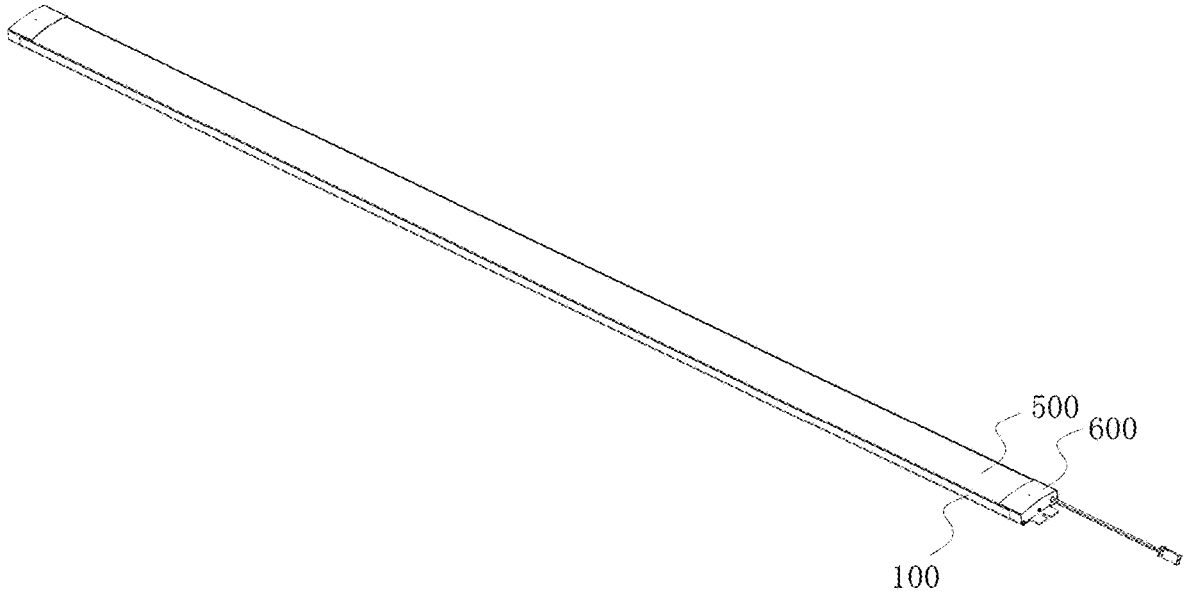
FIG. 1 is a schematic diagram of the three-dimensional structure of a strip lamp according to the present invention.
Figure 2:
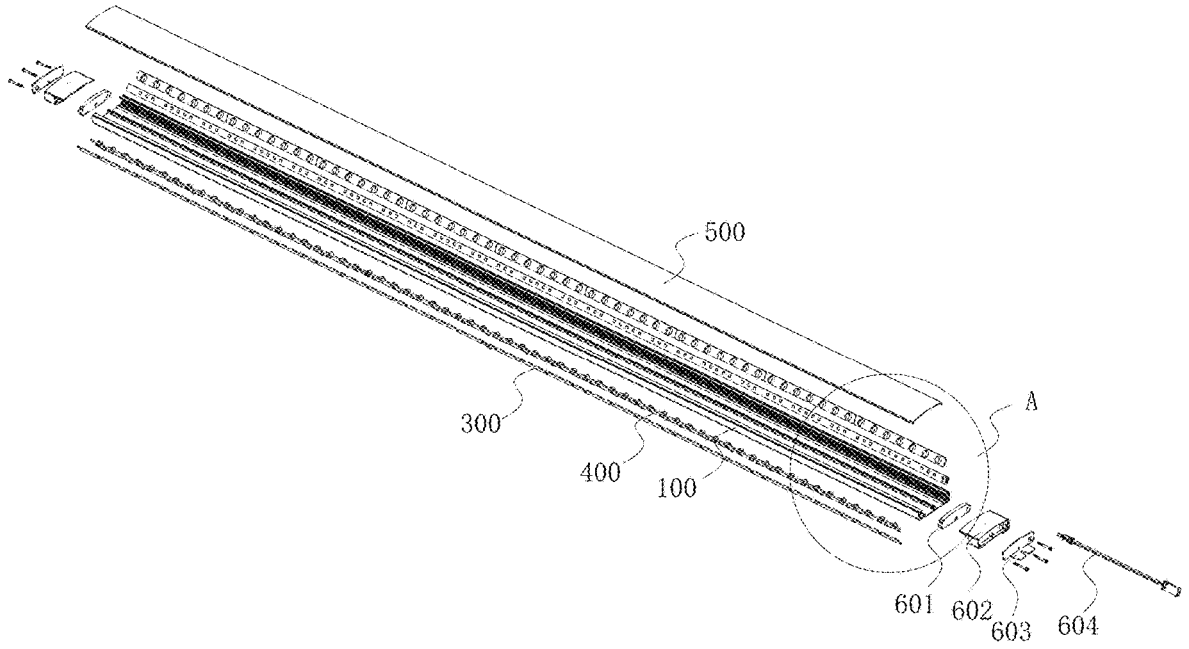
FIG. 2 is an exploded schematic diagram of the strip lamp of FIG. 1.

Hereinafter, specific embodiments of the present invention will be described in further detail based on the drawings. It should be understood that the description of the embodiments of the present invention is not intended to limit the protection scope of the present invention.

As shown in FIGS. 1 to 9, the strip lamp according to the present invention includes a strip lamp holder 100, two rows of light sources 300 and two lenses 400.

The strip lamp of the present invention is provided with light sources and lenses arranged along its length direction, and the main light distribution occurs in a plane perpendicular to its length direction. Therefore, the following content is mainly described based on this plane.

The strip lamp holder 100 has a center line 101 perpendicular to the illuminated surface 200 (the surface to be illuminated) in a plane perpendicular to its length direction. The strip lamp holder 100 is provided with two light source mounting seats 102 oppositely arranged and located on opposite sides of the center line 101. The strip lamp holder 100 is used to support the light source and other components, and is also used for fixing to the installation position.

Each light source mounting seat 102 can be separately arranged and fixed on the strip lamp holder 100, or can be integrally formed with the strip lamp holder 100. Each of the two light source mounting seats 102 is used to install the corresponding light source 300 and lens 400, and is generally set to be opaque, which will have the effect of shielding the light source 300 and the lens 400 on the opposite side to a certain extent, thereby preventing glare problems. This is better than setting a light shielding in the light emission direction of the light source 300 with better anti-glare effect and less light is blocked, which can ensure anti-glare while improving light efficiency.

Figure 3:
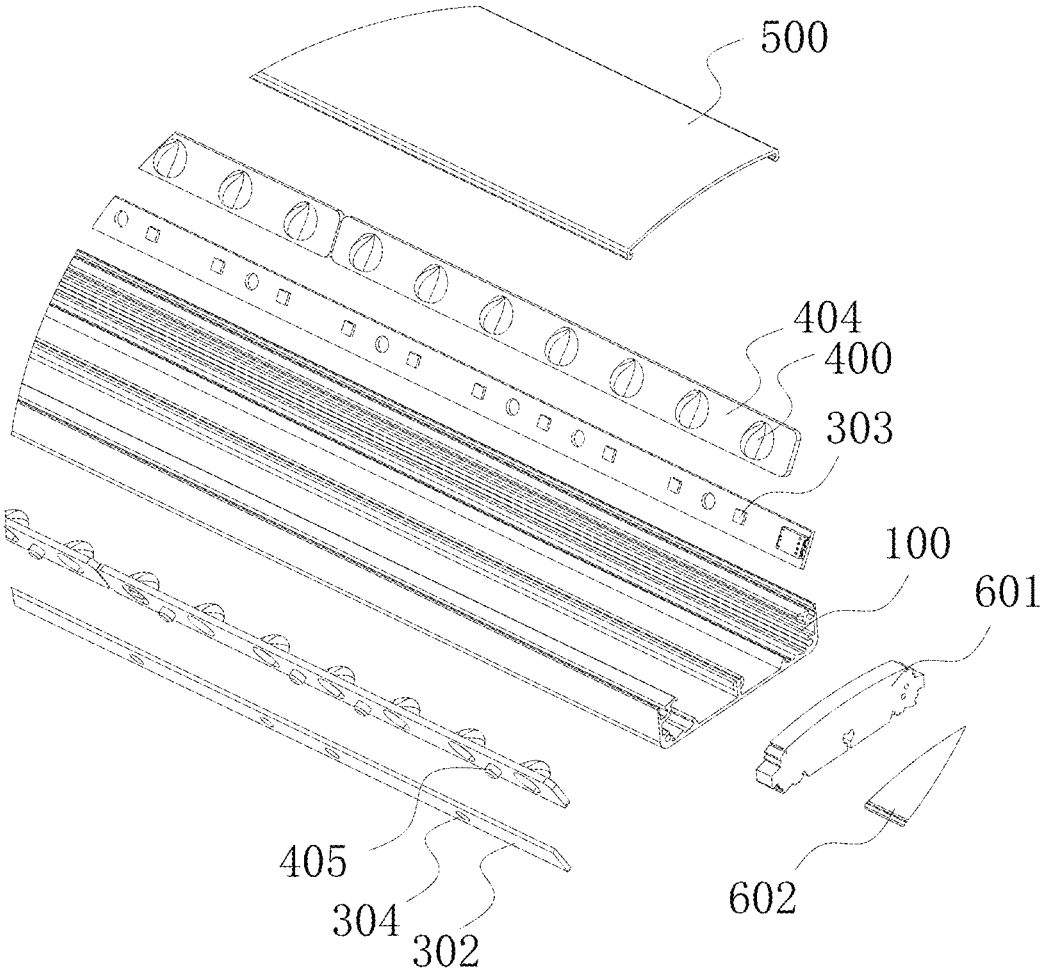
FIG. 3 is an enlarged schematic diagram of part A in FIG. 2.
Figure 4:
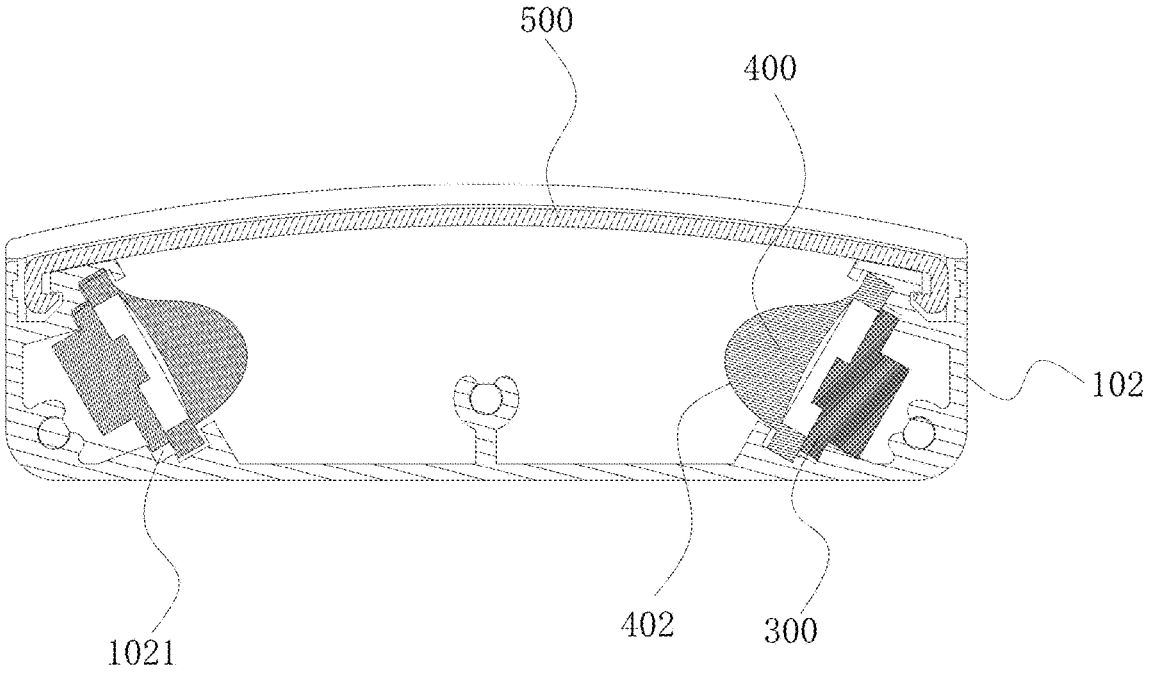
FIG. 4 is a schematic cross-sectional view of a strip lamp according to the present invention on a plane perpendicular to the length direction.
Figure 5:
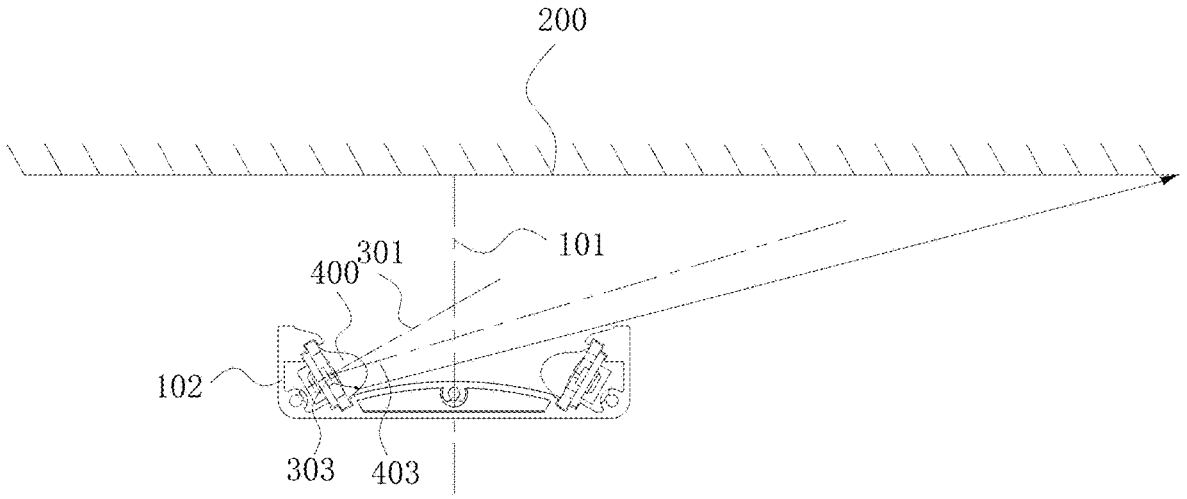
FIG. 5 is a diagram showing the positional relationship between the strip lamp according to the present invention in a plane perpendicular to the length direction and the surface to be illuminated.
Figure 6:
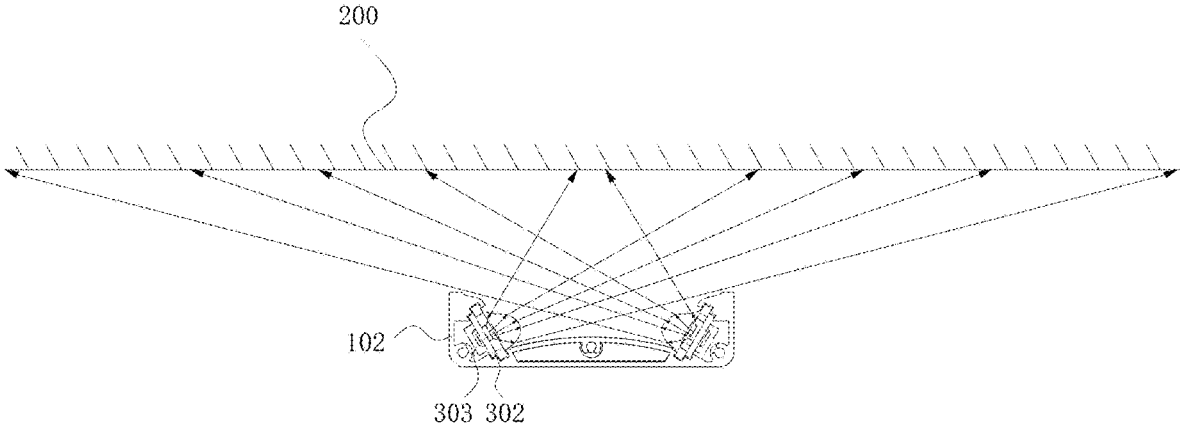
FIG. 6 is an optical path diagram of the strip lamp according to the present invention in a plane perpendicular to the length direction.
Figure 7:
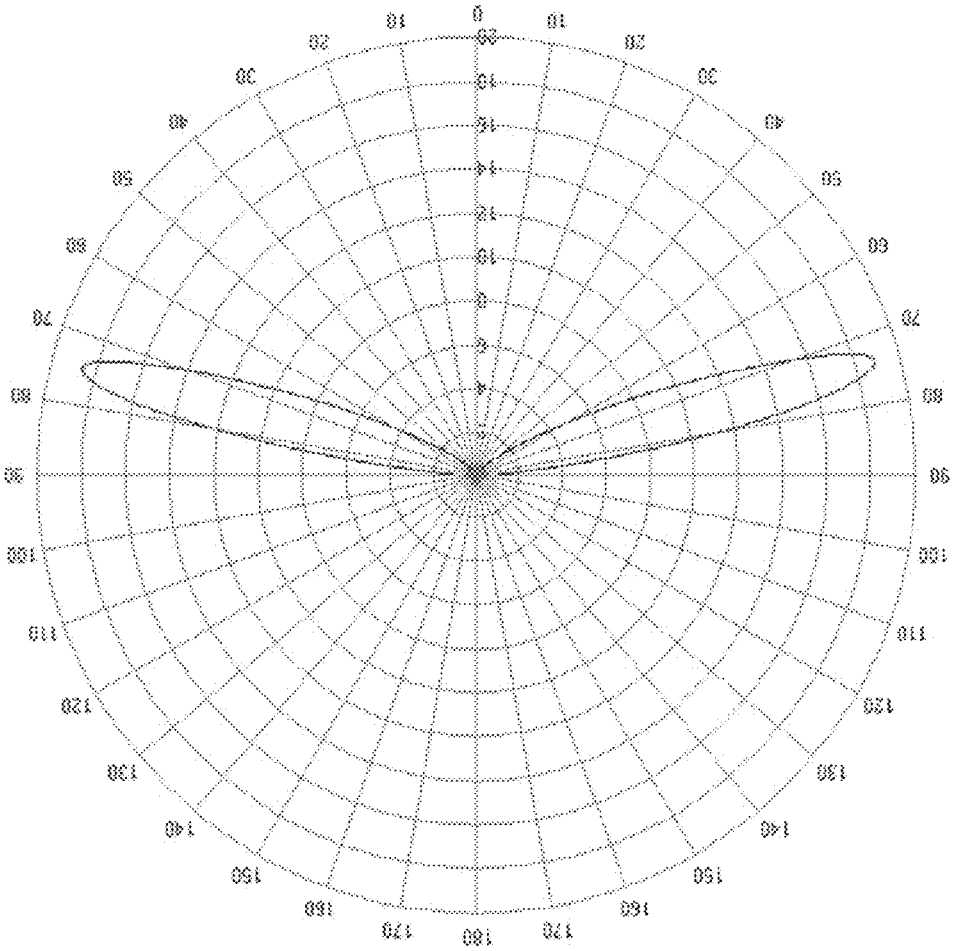
FIG. 7 is a light intensity distribution diagram of the strip lamp of FIG. 6 in a plane perpendicular to the length direction.
Figure 8:
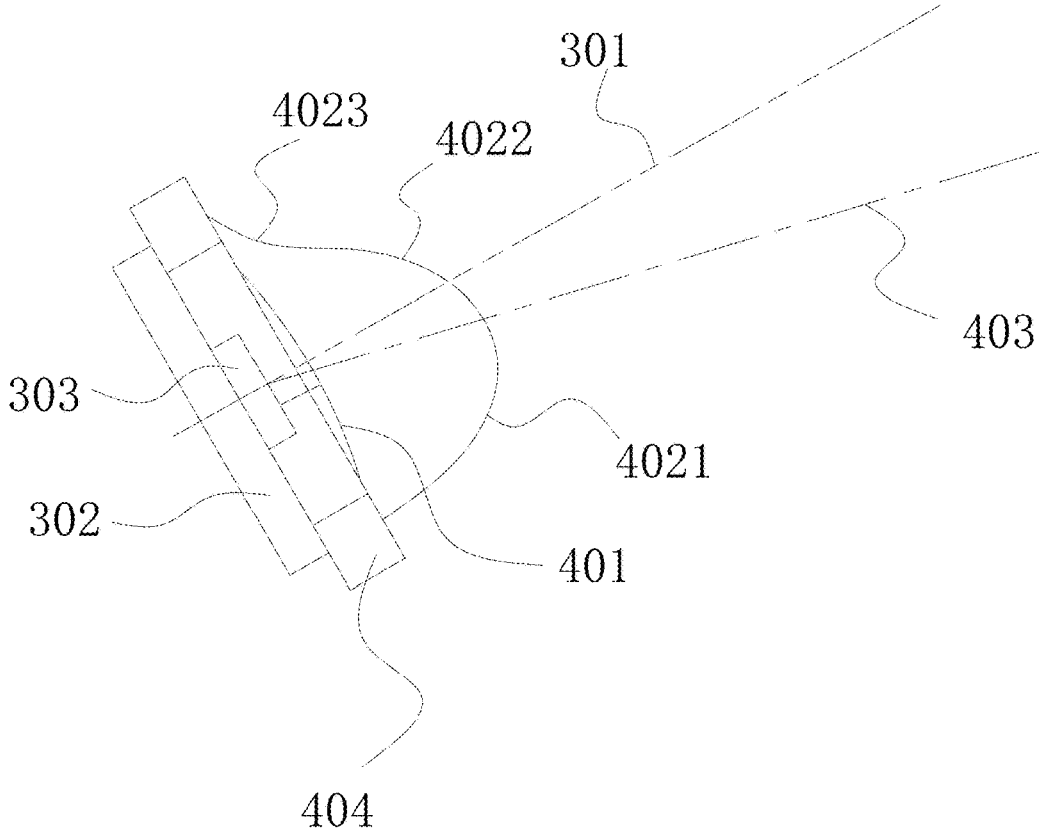
FIG. 8 is a schematic diagram of the enlarged structure of the lens of embodiment strip lamp according to the present invention.

In order to ease assembly of the strip lamp and use of the light source mounting seat 102, in this embodiment, the strip lamp holder 100 is in the form of a U-shaped member having a generally planar basis from which upright side surfaces extend, preferably at an angle of 90 degrees. As shown in FIG. 5, when the strip lamp is installed, preferably the planar basis of the strip lamp extends in parallel with the surface 200 to be illuminated. As shown in FIGS. 3 and 4, U-shaped mounting grooves extend in the length direction along the side surfaces of the strip lamp holder 100, and both side surfaces of the U-shaped groove are used as a light source mounting seat 102.

The two rows of light sources 300 are respectively arranged on the two light source mounting seats 102, so that the light emission directions are all toward the illuminated surface, and the two optical axes 301 intersect at or near the center line 101. It can be seen that the optical axes of the two rows of light sources 300 are each arranged obliquely relative to the illuminated surface 200 (and to the basis of the strip lamp holder 100), so that a larger illumination range can be obtained.

In order to distribute the light of the light source 300 as needed to obtain the required lighting effect, two lenses 400 are each arranged on a light source mounting seat 102 and located in the light emission direction of the corresponding light source 300 and both lenses 400 include a light entrance surface 401 and a light emission surface 402.

The light source mounting seat 102, the light source 300 and the lens 400 mentioned above can be symmetrically arranged about a center line 101, or they can be adjusted appropriately as required. In this embodiment, in order to facilitate manufacturing and make the light distribution more uniform, the two sides of the strip lamp have the similar or same structure and are arranged symmetrically about center line 101.

Although the light source mounting seat 102 can be set so that the light source 300 on the opposite side can emit as much light as possible, when a large illumination range is required and the optical axis 301 has a large inclination angle relative to the center line, there will still be a lot of light blocked. The light of the light source 300 includes the blocked light extending to below the top edge of the light source mounting seat 102 on the opposite side thereof, and a part of the light emission surface 402 away from the illuminated surface 200 causes the blocked light of the light source 300 to be refracted and then to cross the top edge of the light source mounting seat 102 on the opposite side of the light source mounting seat 102. In this embodiment, the part of the light emission surface 402 away from the illuminated surface 200 changes the light direction of the blocked light by refraction, thereby preventing this part of light from being blocked and thus improving the light efficiency.

In order to expand the illumination range while ensuring the light emission efficiency, the included angle between the optical axis 301 and the center line 101 is 50° to 80°. More preferably, the included angle between the optical axis 301 and the center line 101 is 65° to 85°.

After the light of the light source 300 has passed through the corresponding lens 400, its light emission angle and/or light emission direction of maximum intensity will change. Generally, the light output (emission) angle will be decreased. The light emission direction of maximum intensity of the light from the source 300 after passing through the corresponding lens 400 is defined as the light distribution optical axis 403. The included angle between the light distribution optical axis 403 and the center line 101 is preferably 60° to 85°.

In order to improve the light efficiency, the extension line of the light distribution optical axis 403 is preferably located above the top edge of the light source mounting seat 102 on the opposite side thereof. More preferably, the included angle between the light distribution optical axis 403 and the center line 101 is preferably in the range between 70° and 85°.

In order to improve the light efficiency, in the present embodiment, the light from the light source 300 is refracted and distributed by the light entrance surface 401 and the light emission surface 402. The light from the light source 300 is refracted twice in the lens 400 to produce the highest light efficiency.

The light emission surface 402 may include a first light focusing part 4021 and a second light focusing part 4022. The first light focusing part 4021 causes the blocked light of the light source 300 to be refracted and to cross the top edge of the light source mounting seat 102 on the opposite side; is located on the side of the light distribution optical axis 403 away from the irradiation surface 200; and focuses the light corresponding to the light source 300 to the light distribution optical axis 403. The second light focusing part 4022 is located on the side of the light distribution optical axis 403 close to the irradiation surface 200, and focuses the light corresponding to the light source 300 to the light distribution optical axis 403. Both the first light focusing part 4021 and the second light focusing part 4022 are used to converge light toward the light distribution optical axis 403.

In this embodiment, in order to make the light distribution more uniform, the curvature radii of the first light focusing part 4021 and the second light focusing part 4022 vary from large to small from being far away from the light distribution optical axis 403 to close to the light distribution optical axis 403, namely the curvature changes from small to large.

In order to avoid that there is no light in the direction perpendicular to the irradiation surface 200 from the light source 300, the light emission surface 402 further includes a diffusion portion 4023 connected to one end of the second light focusing part 4022 away from the light distribution optical axis 403. The diffusion part 4023 is arranged in the light emission direction of the light source 300 perpendicular to the illuminated surface 200. The connection point of the second light focusing part 4021 and the diffusion part 4023 is the inflection point of the curve surface of the lens.

In order to make the light distribution uniformity better, the light entrance surface 401 is recessed toward the light emission surface 402. The light entrance surface 401 is recessed inward to pre-treat the light. Compared with a flat surface having a diffusion effect to the light, the light reaches the light emission surface 402 more evenly.

Figure 9:
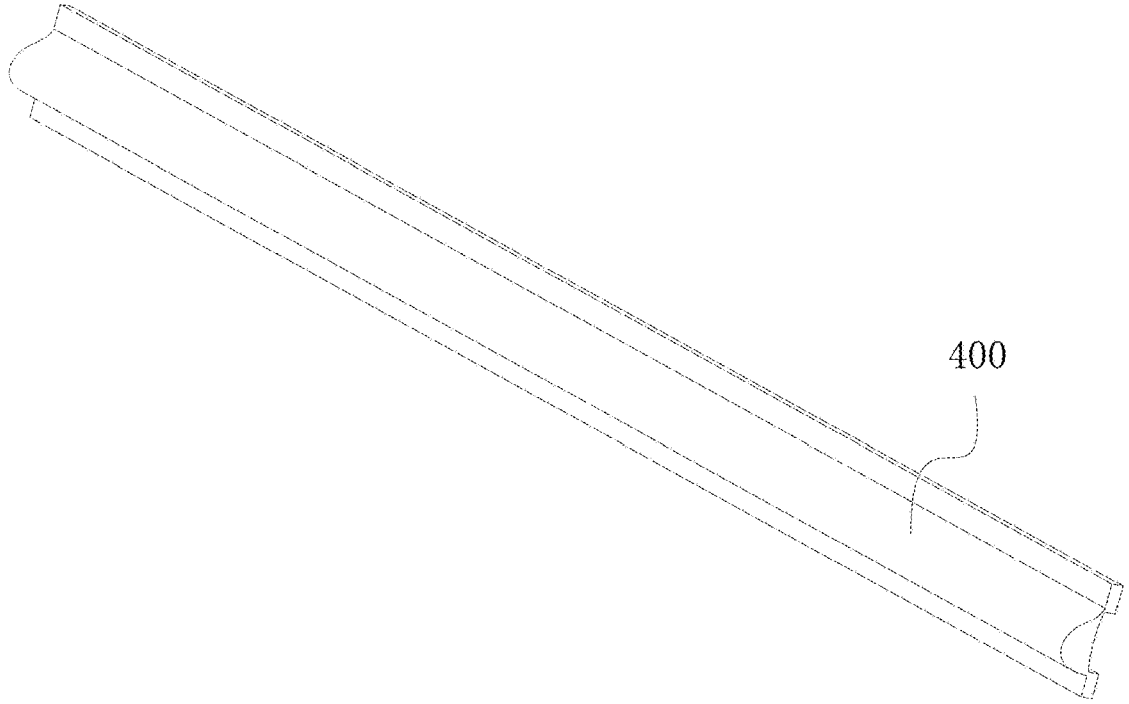
FIG. 9 is a schematic diagram of a three-dimensional structure of a lens of another embodiment according to the present invention.

The structure of the lens 400 passing through the center of the light source 300 and perpendicular to the length direction is the focus of protection of the present application, and its change along the length direction can be selected according to needs. In order to facilitate manufacturing and reduce costs, one embodiment is that the lens 400 is a strip lens extending along the length direction of the strip light holder 100. The strip lens basically does not distribute light in the length direction, as shown in FIG. 9.

In order to improve the light efficiency, another embodiment is that the light source 300 is a plurality of point light sources arranged at intervals along the length direction, and the lens 400 is a single lens provided corresponding to each point light source. The single lens has a light gathering effect in the length direction.

For energy conservation and environmental protection, in this embodiment, the light source 300 adopts an LED light source, which includes a circuit board 302 and a plurality of LED chips 303 arranged on the circuit board 302 and arranged at intervals along the length direction. The light source mounting seat 102 is provided with a mounting slot 1021 into which the circuit board 302 is inserted. When the single lens is used, it can be installed one by one, but in order to facilitate manufacturing, generally multiple single lenses are integrated on a mounting board 404. The back of the mounting board 404 is provided with a fixing post 405 and a fixing hole 304 matched with the fixing post 405 is provided on the circuit board 302, and the fixing post 405 passes through the fixing hole 304 and is hot-scalded on the back of the circuit board 302 to realize a fixed installation.

In order to improve the sealing effect, the strip lamp may further include a lampshade 500 arranged on the strip lamp holder 100 and located outside the lens 400. Further, end cover assemblies 600 may also be provided at both ends of the strip lamp holder 100. The end cover assembly 600 includes an inner cover 601, an outer cover 602, a fixing seat 603 and a patch cord 604.

In order to avoid the light path being changed when the light passes through the lampshade 500, the lampshade 500 may be a convex curved surface along the light emission direction.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. A strip lamp comprising a strip lamp holder (100), two rows of light sources (300) and two lenses (400), wherein:

the strip lamp holder (100) has a center line (101) perpendicular to a surface (200) to be illuminated in a plane perpendicular to its length direction, and the strip lamp holder (100) is provided with two light source mounting seats (102) oppositely arranged and located on opposite sides of the center line (101);

each of the two rows of light sources (300) is respectively arranged on the light source mounting seat (102), so that light emission directions of the two rows of light sources (300) are all toward the surface (200) to be illuminated and so that two optical axes (301) of the two rows of light sources intersect at or near the center line (101); and each of the two lenses (400) is respectively arranged on the light source mounting seat (102) and located in the light emission direction of the corresponding light source (300), and each of the two lenses (400) includes a light entrance surface (401) and a light emission surface (402);

wherein, the light from the light source (300) comprises a blocked light extending to below a top edge of the light source mounting seat (102) on the opposite side thereof, and a part of the light emission surface (402) away from the surface (200) to be illuminated causes the blocked light of the light source (300) to be refracted and then cross the top edge of the light source mounting seat (102) on the opposite side.

2. The strip lamp as claimed in claim 1, wherein an included angle between the optical axis (301) and the center line (101) is in the range between 50° and 80°.

3. The strip lamp as claimed in claim 1, wherein the light emission direction of maximum intensity of the light emitted from the light source (300) after passing through the corresponding lens (400) is defined as a light distribution optical axis (403), and an included angle between the light distribution optical axis (403) and the center line (101) is in a range between 60° and 85°.

4. The strip lamp as claimed in claim 3, wherein an extension line of the light distribution optical axis (403) is located above a top edge of the light source mounting seat (102) on the opposite side.

5. The strip lamp as claimed in claim 3, wherein the included angle between the light distribution optical axis (403) and the center line (101) is in the range between 70° and 85°.

6. The strip lamp as claimed in claim 1, wherein the light from the light source (300) is refracted and distributed on the light entrance surface (401) and the light emission surface (402).

7. The strip lamp as claimed in claim 1, wherein the light emission surface (402) comprises a first light focusing part (4021) and a second light focusing part (4022), and the first light focusing part (4021) causes the blocked light of the light source (300) to be refracted and to cross the top edge of the light source mounting seat (102) on the opposite side thereof, and is located on a side of the light distribution optical axis (403) away from the surface (200) to be illuminated; and focuses the light corresponding to the light source (300) to the light distribution optical axis (403);

the second light focusing part (4022) is located on a side of the light distribution optical axis (403) close to the surface (200) to be illuminated, and focuses the light corresponding to the light source (300) to the light distribution optical axis (403).

8. The strip lamp as claimed in claim 7, wherein the light emission surface (402) further comprises a diffusion part (4023) connected to one end of the second light focusing part (4022) away from the light distribution optical axis (403).

9. The strip lamp as claimed in claim 1, wherein the light entrance surface (401) is recessed toward the light emission surface (402).

10. The strip lamp as claimed in claim 1, wherein the lens (400) is a strip lens extending along the length direction of the strip light holder (100).

11. The strip lamp as claimed in claim 1, wherein the light source (300) comprises a plurality of point light sources arranged at intervals along the length direction, and the lenses (400) are each a single lens provided corresponding to each point light source.

12. The strip lamp as claimed in claim 1, wherein the light source (300) comprises a plurality of point light sources arranged at intervals along the length direction, and the lenses each comprise a mounting board (404) extending along the length direction of the strip light holder (100) into which multiple single lenses are integrated, each of the single lenses being associated with a corresponding light source (303) of the associated row of light sources (300) and each of the single lenses comprising a light entrance surface (401) and a light emission surface (402).

13. The strip lamp as claimed in claim 1, further comprising a lampshade (500) arranged on the strip lamp holder (100) and located outside the lens (400).

14. The strip lamp as claimed in claim 13, wherein the lampshade (500) is an arc-shaped curved surface convex along the light emission direction.

* * * * *